United States Patent [19]

Plauson, deceased et al.

[11] 3,998,676

[45] Dec. 21, 1976

[54] METHOD FOR BOMB MANUFACTURE

[75] Inventors: Richard A. Plauson, deceased, late of China Lake, Calif.; by Mary E. Plauson, legal representative, Ridgecrest, Calif.; William McBride, Williamsburg, Va.

[73] Assignee: The United States of America as represented by the Secretary of the Navy, Washington, D.C.

[22] Filed: July 29, 1974

[21] Appl. No.: 492,637

[52] U.S. Cl. ..... 149/7; 149/5; 149/37; 149/87

[51] Int. Cl.[2] ..... C06B 45/34; C06B 45/30; C06B 33/00; C06B 27/00

[58] Field of Search ..... 149/7, 5, 37, 87

[56] References Cited

UNITED STATES PATENTS

| | | | |
|---|---|---|---|
| 2,872,422 | 2/1959 | Rolle | 117/135 |
| 3,249,474 | 5/1966 | Clay | 149/6 |
| 3,252,842 | 5/1966 | Williams | 149/6 |
| 3,297,502 | 1/1967 | Chrisp | 149/6 |
| 3,351,464 | 11/1967 | Bundincsevits | 117/100 M |
| 3,376,174 | 4/1968 | Napoly | 149/13 |
| 3,420,695 | 1/1969 | Rice | 117/100 M |
| 3,507,719 | 4/1970 | Hodgson | 149/6 |
| 3,781,177 | 12/1973 | Kondis | 149/6 |

FOREIGN PATENTS OR APPLICATIONS

| | | |
|---|---|---|
| 1,318,773 | 1/1962 | France |

*Primary Examiner*—Samuel W. Engle
*Assistant Examiner*—Donald P. Walsh
*Attorney, Agent, or Firm*—R. S. Sciascia; Roy Miller; T. W. Hennen

[57] ABSTRACT

Aluminum particles are coated with a composition containing 84 ± 3 weight percent desensitizing wax, 2 ± 0.5 weight percent lecithin and 14 ± 1 weight percent nitrocellulose prior to being mixed with other ingredients of an explosive composition in a bomb manufacturing process in order to eliminate the possibility of dust explosions occurring during the bomb manufacturing process.

1 Claim, No Drawings

METHOD FOR BOMB MANUFACTURE

BACKGROUND OF THE INVENTION

1. Field of the Invention

This invention relates to bomb manufacturing processes in which aluminum powder is used as an ingredient of the bomb explosive.

2. Description of the Prior Art

In the prior art, a common method in the manufacture of bombs and the like has been to place "hat boxes" (containers) on a conveyor belt and dump appropriate amounts of the various components of the explosive composition into them from measuring hoppers placed at strategic points along the conveyor belt. When the "hat boxes" containing the various components of the explosive composition reach the end of the conveyor belt they are manually picked up, their contents are dumped into melting kettles for mixing and pouring into bombs and the "hat boxes" are sent back, via another conveyor belt, for refilling.

The above-described process is satisfactory for use in the manufacture of small quantities of bombs (a few hundred per day). However, in order to manufacture larger numbers of bombs (thousands per day), it has been found necessary to eliminate the "hat boxes" and their manual handling at the end of the conveyor belt and replace this technique with more automated means. It has been found that the process can be greatly speeded up by merely dumping appropriate amounts of explosive powder (TNT, Composition B or the like), fuel (metallic powder) and other ingredients directly onto the conveyor belt so that amounts of the combined ingredients dump directly from the end of the conveyor belt into the melting kettles for further handling. However, particularly because of the metallic powder used, this process is hazardous and this process is extremely hazardous when aluminum powder is used as the fuel.

Once aluminum powder is on the conveyor belt in contact with the other ingredients of the explosive composition and in the presence of large amounts of air, an electric spark or even heat caused by friction somewhere along the belt can set off dust explosions. Even aluminum powder alone in the presence of plentiful air is hazardous. It is, accordingly, an objective of this invention to negate the above-described hazard.

SUMMARY OF THE INVENTION

It has now been found that the hazards which present themselves when aluminum powder is placed on an open conveyor belt with other ingredients of an explosive composition in the presence of air are largely eliminated if the aluminum powder is coated with wax prior to its being placed on the conveyor belt. The particular wax used and the method for coating aluminum powder with it are specifically described below.

DESCRIPTION OF AN EMBODIMENT

According to the present invention, aluminum particles are coated with a composition containing 84± 3 weight percent desensitizing wax, 2 ± 0.5 weight percent lecithin and 14 ± 1 weight percent nitrocellulose prior to being added to other ingredients of an explosive composition on a conveyor belt in a bomb manufacturing process. The composition with which the aluminum particles are coated is, in military terminology, referred to as composition D-2. Composition D-2 is fully described in military specification MIL-C-18164A which is unclassified and available to the public.

The desensitizing wax which forms part of composition D-2 is described in military specification MIL-W-20553 which is unclassified and available to the public.

Nitrocellulose is, of course, well known. However, nitrocellulose suitable for use in composition D-2 is described in military specification MIL-N-244A which is unclassified and available to the public.

Lecithin is, like nitrocellulose, well known. It is an extract of soybeans. However, for the readers information, military specification MIL-L-3061 which is unclassified and available to the public describes lecithin which is suitable for use in composition D-2.

According to this invention, coated particles may be prepared by (1) adding aluminum powder which has been comminuted to the desired particle size range by any known method to composition D-2 which has been rendered molten by means of a steam jacketed kettle or the like, (2) stirring and (3) allowing the molten composition D-2 to cool and solidify. Not more than 18 weight percent composition D-2 per 82 weight percent aluminum and not less than 2 weight percent composition D-2 per 98 weight percent aluminum may be used.

If more than 18 weight percent composition D-2 is used, the coated particles form agglomerates which are unsuitable for use in explosives.

If less than 2 weight percent composition D-2 is used, the aluminum particles are not heavily enough coated to eliminate the dust explosion hazard which this invention is meant to eliminate.

Coated particles according to this invention may also be prepared by adding comminuted aluminum to a lacquer containing composition D-2 dissolved in a solvent and then adding another solvent which extracts the lacquer solvent but which is not a solvent for composition D-2.

After being coated, aluminum particles are, according to this invention, used in the manner described above in the BACKGROUND OF THE INVENTION. That is, suitable amounts of coated aluminum particles are dumped, by means of a strategically placed hopper, onto an open conveyor belt along with suitable amounts of other ingredients of an explosive composition and the thus combined ingredients are delivered, by the conveyor belt, to melting kettles for melting and pouring into bomb casings where they set. Insofar as the other ingredients are concerned, any group of ingredients with which aluminum particles can ordinarily be used as a compatible and useful component is satisfactory. Also, the size range of the aluminum particles may be determined according to whatever specificions may be desirable for the particular explosive composition in question.

What is claimed is:

1. In a process for manufacturing bombs wherein aluminum particles, other ingredients, and a waxy composition comprising by weight 84±3 percent desensitizing wax, 2±0.15 percent lecithin, and 14±1 percent nitrocellulose, are deposited in predetermined quantities from separate hoppers and combined on a conveyor belt and delivered by said conveyor belt to a melting kettle for further handling, the improvement which resides in the steps of:

melting a predetermined quantity of said waxy composition in a crucible means, combining with said molten waxy composition a predetermined quantity of separate aluminum particles to achieve a mixture that is by weight within the range of from 82 to 98 percent aluminum, stirring said separate aluminum particles and waxy composition mixture with stirring means until a uniform aluminum particulate distribution is achieved in said mixture, cooling said mixture until said waxy composition solidifies and forms a separate coating on each of said separate aluminum particles in said mixture, placing said separate waxy composition coated aluminum particles in a dispensing hopper, and dispensing said separate waxy composition coated aluminum particles from said hopper directly onto said conveyor belt in predetermined quantities and at appropriate times for further processing in the manufacture of bombs, for eliminating the dangers of fire and explosion presented by aluminum particles when exposed to air.

* * * * *